United States Patent [19]

Perry

[11] 4,406,587

[45] Sep. 27, 1983

[54] VIBRATION ACTUATED LIQUID PUMP

[76] Inventor: John C. Perry, 3170 Falcon Dr., Carlsbad, Calif. 92008

[21] Appl. No.: 252,383

[22] Filed: Apr. 9, 1981

[51] Int. Cl.[3] ..... F04B 37/00

[52] U.S. Cl. ..... 417/211; 417/241

[58] Field of Search ..... 417/211, 241, 441

[56] References Cited

U.S. PATENT DOCUMENTS

| | | | |
|---|---|---|---|
| 1,831,995 | 11/1931 | Braselton et al. | 417/211 |
| 1,870,707 | 8/1932 | Braselton et al. | 417/211 |
| 2,572,977 | 10/1951 | Bodine | 417/241 |
| 2,914,240 | 11/1959 | Vorech | 417/211 |
| 3,116,695 | 1/1964 | Faller | 417/241 |

FOREIGN PATENT DOCUMENTS

| | | | |
|---|---|---|---|
| 415491 | 6/1925 | Fed. Rep. of Germany | 417/240 |

*Primary Examiner*—William L. Freeh
*Attorney, Agent, or Firm*—Robert G. Upton

[57] ABSTRACT

A positive displacement liquid pump having a free stroking piston slidably positioned within a cylindrical housing is disclosed. A pair of cooperating one-way valves, one valve communicating with a central passage defined by the piston while the other valve communicates with an inlet to the housing, coact to draw in fluid from a source of liquid. As the piston moves away from the inlet the one-way inlet valve opens filling a chamber behind the piston. The one-way valve in the piston simultaneously closes enabling the piston to drive fluid out of the reservoir chamber at an exit end of the housing, the valves acting oppositely when the piston oscillates back toward the housing inlet. The free stroking piston within the pump is set in motion by the oscillatory motion of vibration alone without direct mechanical piston actuation from a power source. The pump may cooperate with a fluid regulator to control flow of fluid from the pump housing.

3 Claims, 9 Drawing Figures

VIBRATION ACTUATED LIQUID PUMP

BACKGROUND OF THE INVENTION

1. Field of the Invention

This invention relates to positive displacement fluid pumps.

More particularly, this invention relates to a positive displacement liquid pump with integral fuel regulating means which is actuated solely by a source of vibration. The pump housing is so mounted to be within vibratory range of a source of vibration.

2. Description of the Prior Art

There are many positive displacement pumps within the state of the art, all of which are actuated either mechanically or through a directly connected source of pulsating pressure.

All of these prior art devices are disadvantaged in that the pumps must be either mechanically or directly connected through a hose or conduit means to a pump driving source whether it be a reciprocating engine or an electric motor. Either way, the pump drains off power and energy from its driving source.

The present invention requires no physical attachment whatsoever either through mechanically actuatable rods or hose connections to actuate the pump. Hence there is absolutely no power drain or loss of efficiency to associated equipment. The invention is actuated by the oscillatory action of a source of vibration which drives a free stroking piston within a cylinder back and forth, thereby actuating a pair of coacting one-way valves to draw in and expel liquid through the pump. The sole actuating means is a source of vibration, the pump being axially aligned with the propagating direction of the oscillatory motion set up by the source of vibration. For example, an operating two-cycle engine secured to an engine mount vibrates and sets up oscillating motion through the torque generated by the engine. The pump then, when mounted to the firewall of the engine, is subject to oscillatory vibrational motion. The vibration alone is sufficient to drive the piston within the pump axially back and forth, thus supplying, for example, fuel to the carburetor of the engine.

A disadvantage associated with all of the prior art positive displacement pumps is their direct dependence on a source of power to drive the pump either through actuation rods or hose connections, thereby parasitically draining power from its driving source.

The present invention obviates the foregoing disadvantage by driving a positive displacement fluid pump through vibration alone, the pump being remote from the source of vibration but within the influence of its oscillatory motion.

SUMMARY OF THE INVENTION

It is an object of this invention to provide a positive displacement fluid pump driven solely by vibrational means.

More particularly, it is an object of this invention to provide a positive displacement liquid pump with integral pump regulating means that is driven solely by oscillatory motion set up by a source of vibration, the pump being remote from the vibration mechanism but substantially within the oscillatory influence of the vibration.

A positive displacement pump for pumping liquids consists essentially of an elongated body which forms a first liquid inlet end and a second liquid exit end. The body further defines a cylindrical bore therethrough. A free stroking piston with a first pumping end and a second suction end is slidably contained within the cylindrical bore. The piston additionally forms a passageway therethrough. The piston, when positioned approximately halfway within the cylindrical bore, defines a first liquid inlet chamber formed between the second suction end of the piston, an inner wall of the cylindrical bore formed by the body and the first inlet end. A second liquid reservoir chamber is formed between the first pumping end of the piston, the inner wall of the cylindrical bore and the second liquid exit end. The first liquid inlet chamber and the second liquid reservoir chamber varies in volume as the piston moves axially within the cylindrical bore.

A first spring is positioned adjacent the first pumping end of the piston and a second spring is positioned adjacent the second suction end of the piston to amplify oscillations of the piston axially to and fro within the cylindrical bore. A source of liquid is directed to the first liquid inlet end. A first one-way valve is secured to the body and is in liquid communication with the first liquid inlet end. A second one-way valve is secured to the piston in liquid communication with the passageway formed by the piston. The second valve is closed when the piston moves within the cylindrical bore toward the second liquid exit end, thereby forcing any liquid within the second liquid reservoir chamber out of the exit end. The first one-way valve communicating with the first liquid inlet end opens substantially simultaneously as the piston moves toward the liquid exit end, drawing liquid through the first liquid inlet end from the source of liquid substantially filling the first liquid inlet chamber. When the piston reverses direction at the end of its stroke, the one-way valve in communication with the first liquid inlet end is closed and the valve in the piston opens thus transferring liquid into the reservoir chamber, thereby completing one cycle of the pump.

A liquid regulating means is integral with the second liquid exit end of the elongated body. The liquid regulating means includes a resilient diaphragm actuated valve to control liquid flow through a valve seat formed in the second liquid exit end of the body. The resilient diaphragm is rigidized by circumferential enlargement of the diameter of the diaphragm by a diaphragm enlargement ring means, thereby stretching the diaphragm to effectuate precise control of the valve relative to its valve seat formed in the second liquid exit end of the body.

A vibration means is positioned substantially adjacent the elongated body. Vibratory motion, upon operation of the vibration means, is oriented substantially parallel with an axis of the body to move the free stroking piston axially to and fro within the body to pump liquid therethrough from the liquid source.

An advantage then over the prior art is the nonparasitic attachment to a source of power to drive a fluid pump, the pump of the present invention being driven solely by vibrational means.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
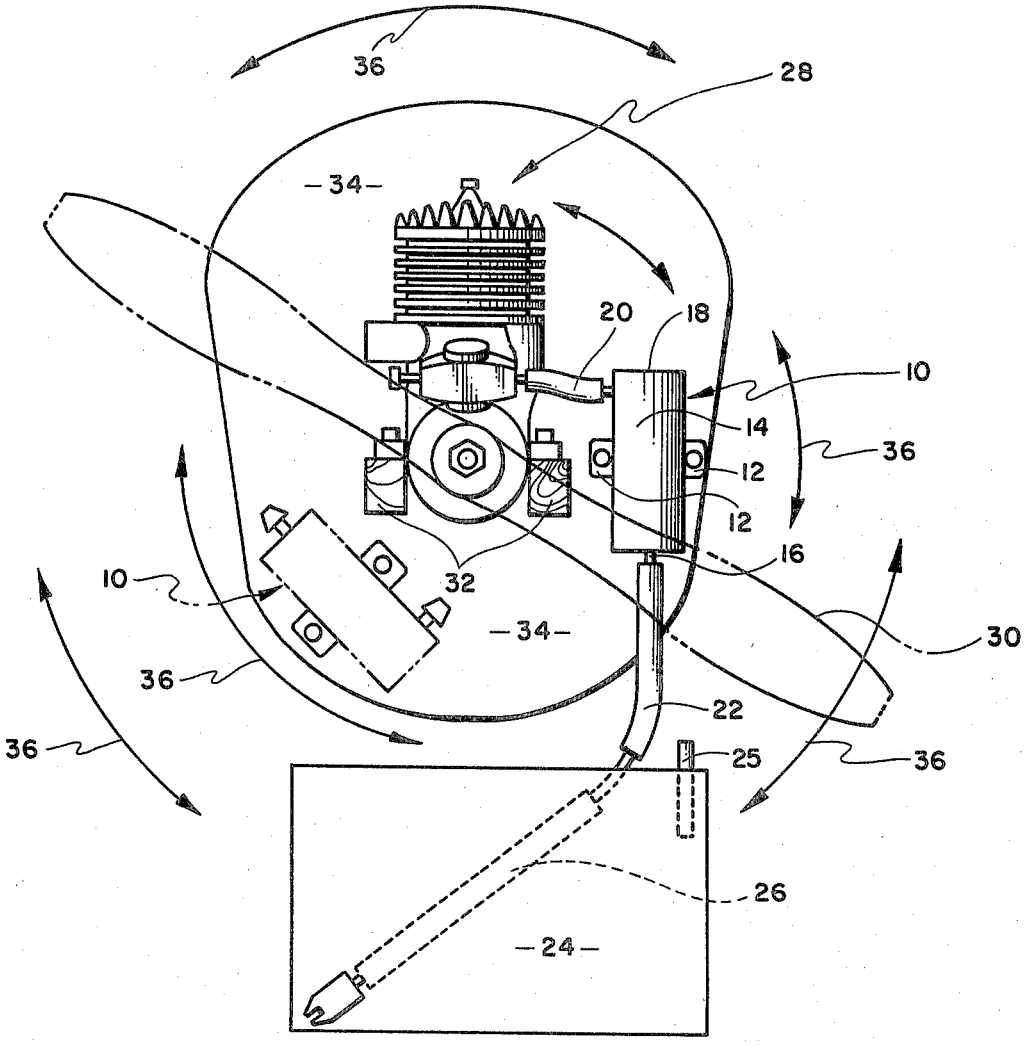
FIG. 1 is a semi-schematic view of the pump of the present invention illustrated in an operating environment.

The semi-schematic view of FIG. 1 illustrates a positive displacement liquid pump, generally designated as 10, consisting of housing 14 with mounting lugs 12 attached to the housing. The housing 14 further defines an inlet end 16 and a fluid outlet end 18. The pump 10 pumps liquid from a tank 24 through tank pickup 26 through conduit 22 and in the pump inlet end 16. The fuel is pumped through end 18 into conduit 20 which is affixed to the carburetor of the engine, generally designated as 28. The engine illustrated, for example, is a two-cycle miniature engine that drives a propeller 30. The engine is mounted securely to a pair of engine mounts 32 which are affixed to a firewall 34. During operation of the engine, the engine generates torque while driving the propeller 30 through its arc. The engine then vibrates on its mount 32 and sets up oscillatory modes 36 which transmit generally in the direction as illustrated. This vibration or oscillatory motion is transmitted to the pump 10, the axis of which is generally aligned with the direction of the oscillatory motion 36. The vibration of the two-cycle engine 28 then causes a piston (FIG. 2) to oscillate or travel to and fro within the housing 14 of pump 10. Vibration alone then generated by the operating engine 28 provides a means to drive the pump to supply the carburetor of the engine with a source of fuel under pressure. The pump in this example is provided with a fuel regulator integral with the outlet end 18 of housing 14 to provide regulated fuel to the carburetor of the engine 28. In the foregoing example, one-half pounds per square inch of pressure is provided to supply the proper amount of fuel under pressure to the carburetor of the two-cycle engine.

It should be noted here that the pump 10' illustrated in phantom on the firewall may be oriented anywhere on the firewall as long as it is substantially oriented axially in the direction of the oscillatory motion generated by the engine. It should be further noted that the pump need not be mounted to the firewall as long as it is subjected to the vibratory action generated by the engine.

Figure 2:
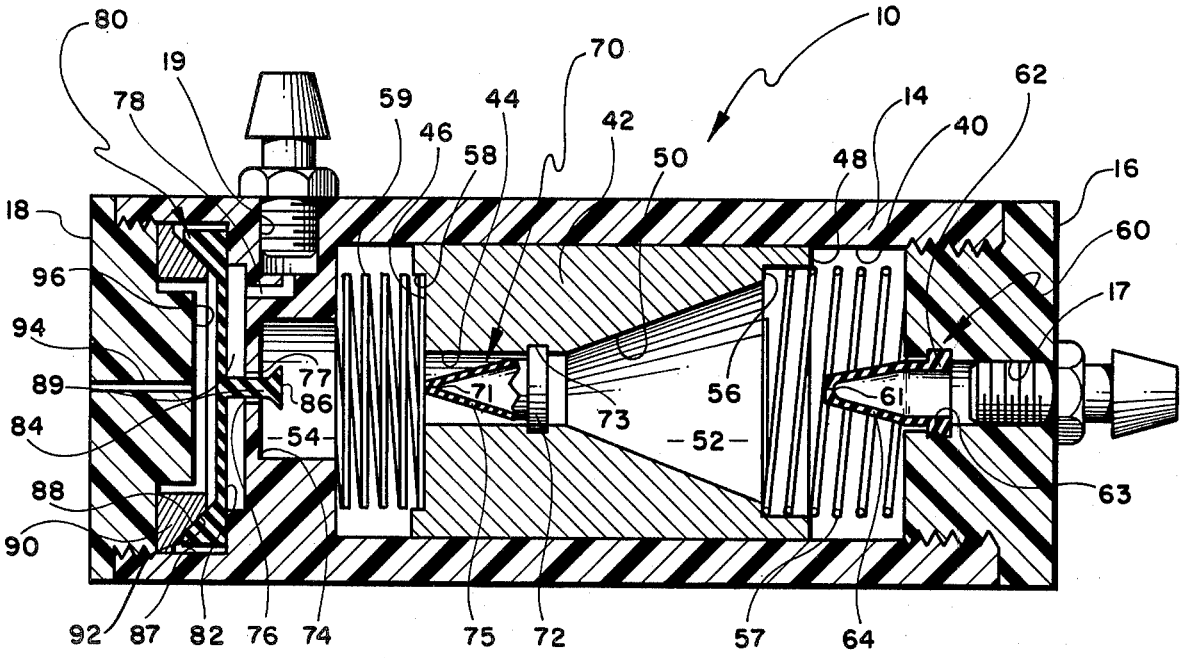
FIG. 2 is a cross sectional view of the pump assembly.

Turning now to the cross section of FIG. 2, the pump generally designated as 10 consists of an elongated housing which defines a cylindrical bore 40 within the housing. The body may be fabricated from many different materials. Nylon, however, is an ideal material since it provides a material which generally is impervious to many types of liquids that may be subjected to the pump. A free stroking piston 42 is slidably engaged with the bore 40 of housing 14. The piston is preferably heavy, fabricated from a highly dense metal such as brass, although the piston may be fabricated from nylon filled with mercury or lead to provide the mass to maintain momentum within bore 40. The piston has a passageway 44 to allow passage of liquid from one side of the piston to the other. The skirt or suction end 48 of piston 42 defines an inner ledge or groove 56 which serves to support a piston return spring 57, the inner ledge 56 serving to prevent the spring from contacting the inner bore 40 of housing 14. At the pumping end 46 of piston 42 is a similar ledge or ridge to facilitate a second piston return spring 59. The piston 42 then is retained within bore 40 of housing 14 by ends 16 and 18 of the housing, the springs 57 and 59 serving to amplify the oscillatory motion of the highly dense piston 42 within bore 40.

Figure 4:
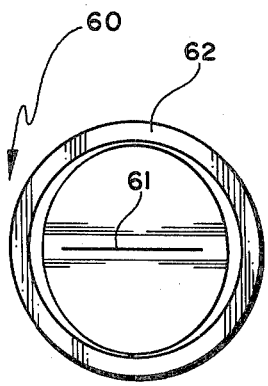
FIG. 4 is a view taken through 4—4 of FIG. 3.
Figure 3:
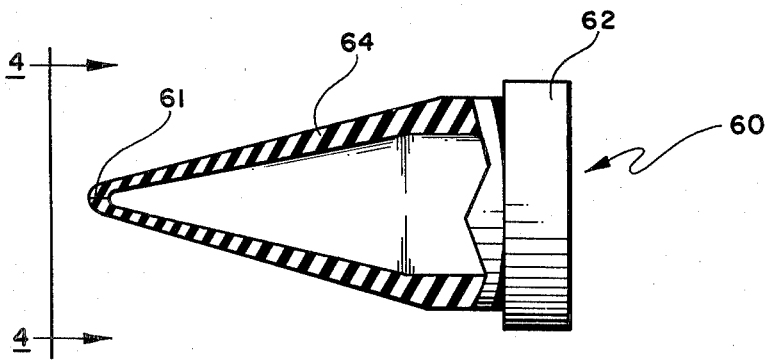
FIG. 3 is a partial cross section of an enlarged resilient valve.

At the inlet end 16 of housing 14 is an inlet port 17. An inlet fitting or nipple is positioned within passageway 17 to admit liquid within the housing 14. Interiorly of end 16 within passageway 17 is positioned a one-way rubberlike valve, generally designated as 60. The valve is retained within passageway 17 by a circular groove 63 in end 16. The one-way valve 60 is provided with a circular shoulder 62 which snaps into groove 63 in end 16. The valve 60 is shown in more detail with reference to FIGS. 3 and 4. At the end of the valve 60 is a slit 61 which is cut into the valve 60. An identical valve 70 is positioned within passageway 44 of piston 42, the valve 70 having a shoulder 72 which snaps into a retention groove or ridge 73 milled into the piston 42. The valve 70 has a slit 71 which is illustrated in FIGS. 3 and 4. Both valves 60 and 70 have thin wall sections 64 and 75 to assure that the valve will actuate and be sensitive to small pressure changes acting on the walls 64 and 75. The valves 60 and 70 are actuated by movement of the piston 42 within bore 40. For example, if the piston should move towards end 18 of housing 14 the chamber 52 defined by the inner walls 50 of piston 42, cylinder 40 and the end 16 is enlarged. In other words, the volume is increased, causing valve 70 to remain closed while opening slit 61 in valve 60 allows liquid entering through end 16 to fill the increased volume within chamber 52. Simultaneously the pumping end 48 of the piston forces fluid out of the reservoir chamber 54, defined by piston end 48, cylinder 40 and end 18. When the piston 42 moves toward end 16, slit 71 of valve 70 opens, allowing the fluid within chamber 52 to transfer through the valve 70 into reservoir chamber 54 within housing 14. The valve 60 remains closed so that the fluid within chamber 52 does not escape through inlet 16 back to the source of liquid. The liquid exit end 18 defines a fuel regulating means which regulates liquid through port 76 past valve 86 which is integral with a diaphragm, generally designated as 80. The diaphragm is a rubberlike material which is held in place by ring 90. The ring 90 has a 45° surface 92 which engages a 45° surface 88, molded into the rubberlike diaphragm 80. The outside diameter of the diaphragm 80 is less than the diameter 87 machined in the housing 14. As the ring 90 advances toward the diaphragm 80, the diameter of the diaphragm is increased. Stretching the diaphragm serves to rigidize the diaphragm thereby controlling, more precisely, the valve 86 connected to stem 84 which is integral with the diaphragm. This type of diaphragm control thus eliminates the need for a spring to provide tension for the diaphragm. End 96 of the exit end 18 serves to prevent the valve 86 from being pulled out through opening 76 in wall 74 of housing 14. A vent 94 is provided in end 18 to allow the diaphragm to freely actuate during operation of the pump. The tension on the rubberlike diaphragm 80 and the distance of the valve 86 from valve seat 77 determines the pressure at which the valve will actuate and, hence, the flow rate through the pump. When the piston 42 moves toward fluid exit end 18, the volume within reservoir chamber 54 is reduced, thereby forcing liquid through opening 76, past valve seat 77 and valve 86, into chamber 89, defined between diaphragm 80 in wall 74. The fluid enters port 78 which leads to fluid exit passageway 19 and out of the pump.

During operation of the pump then, vibratory motion, which is oscillating generally in an axial direction with the housing 14 of pump 10, causes the piston 42 to oscillate to and fro within bore 40 of housing 14. As the piston 42 moves toward liquid exit end 18, valve 60 opens, allowing liquid to be drawn through passageway 17 into chamber 52. The liquid in the reservoir chamber 54 is forced out the chamber 54 because the valve 70 is closed. The liquid passes by valve 86, past seat 77 in wall 74, through opening 76, into chamber 89 which directs the liquid out through port 78 into the exit 19 and out of the pump 10. Spring 59 is compressed as the piston is moved towards end 18 at the end of the stroke. The spring amplifies the piston as it oscillates back towards end 16 of housing 14, thus opening the slit 71 in valve 70 allowing the liquid in chamber 52 to pass through the opening 71 into reservoir chamber 54. The valve 60 is closed as slit 61 of the valve is forced closed by the pressure of the liquid within the diminishing volume of chamber 52 as the piston 42 is moved toward end 16. Of course, the spring 57 is compressed by the kinetic energy of the heavy piston as it moves toward end 16. The cycle is repeated as spring 57 amplifies the motion of the piston towards liquid exit end 16.

Figure 5:
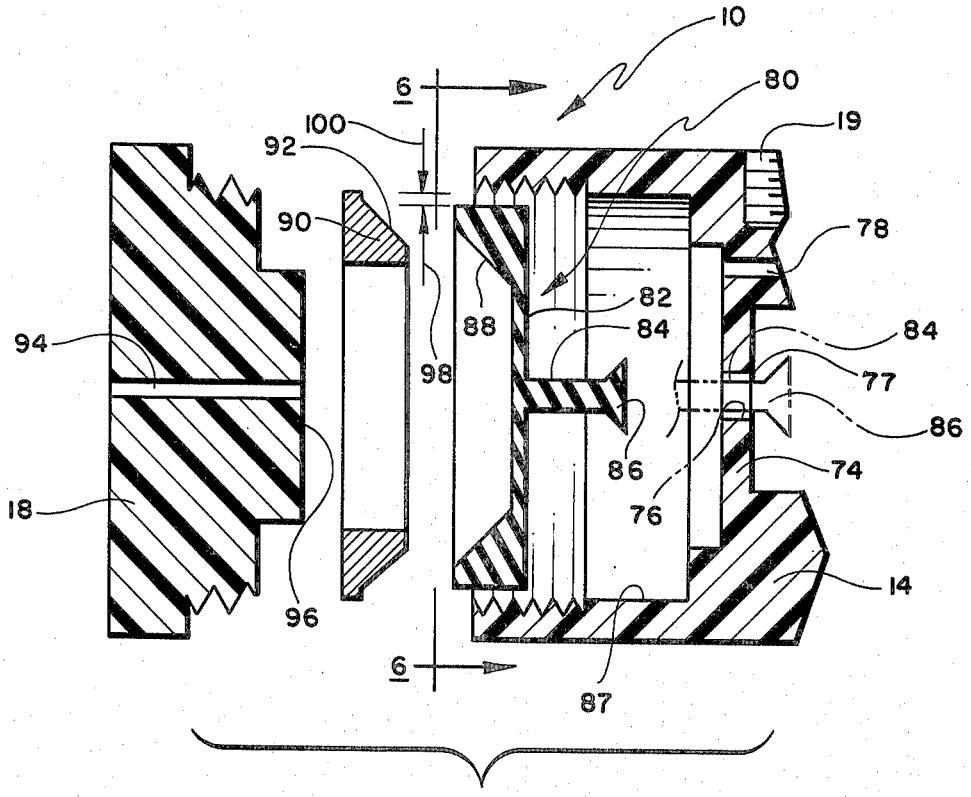
FIG. 5 is a partial cross sectional exploded view of the fluid regulator of the present invention.
Figure 6:
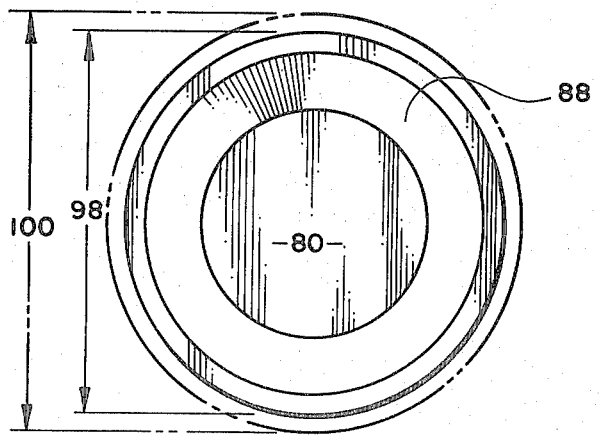
FIG. 6 is a view taken through 6—6 of FIG. 5 illustrating the resilient diaphragm of the regulator.

Turning now to FIG. 5, the exploded view illustrates the regulatory end of the pump 10. The diaphragm 80 is fabricated from a rubberlike material, such as silicon. The diaphragm is fabricated with a lesser diameter than the cylindrical opening 87 in housing 14 to allow room for expansion. The diaphragm is expanded from its natural state as indicated as 98 in FIG. 6 to an expanded rigidized diameter 100. The diaphragm 80 is ridigized by providing a 45° angle 88 in one side of the diaphragm which mates with an identical 45° angle 92 within diaphragm expansion ring 90. As the ring 90 is advanced towards wall 74 in housing 14, the diaphragm gradually expands to enlarged diameter 100 (FIG. 6), thus stiffening the diaphragm. Therefore it follows that the valve 86, attached to stem 84 of diaphragm 80, is tightly controlled so that it precisely actuates with reference to the pressure differential between reservoir chamber 54 and chamber 89 as the liquid passes by valve 86, past seat 77 of opening 76. End 18 is provided with a vent hole 94 to facilitate operation of the diaphragm regulator within the housing 14.

Figure 7:
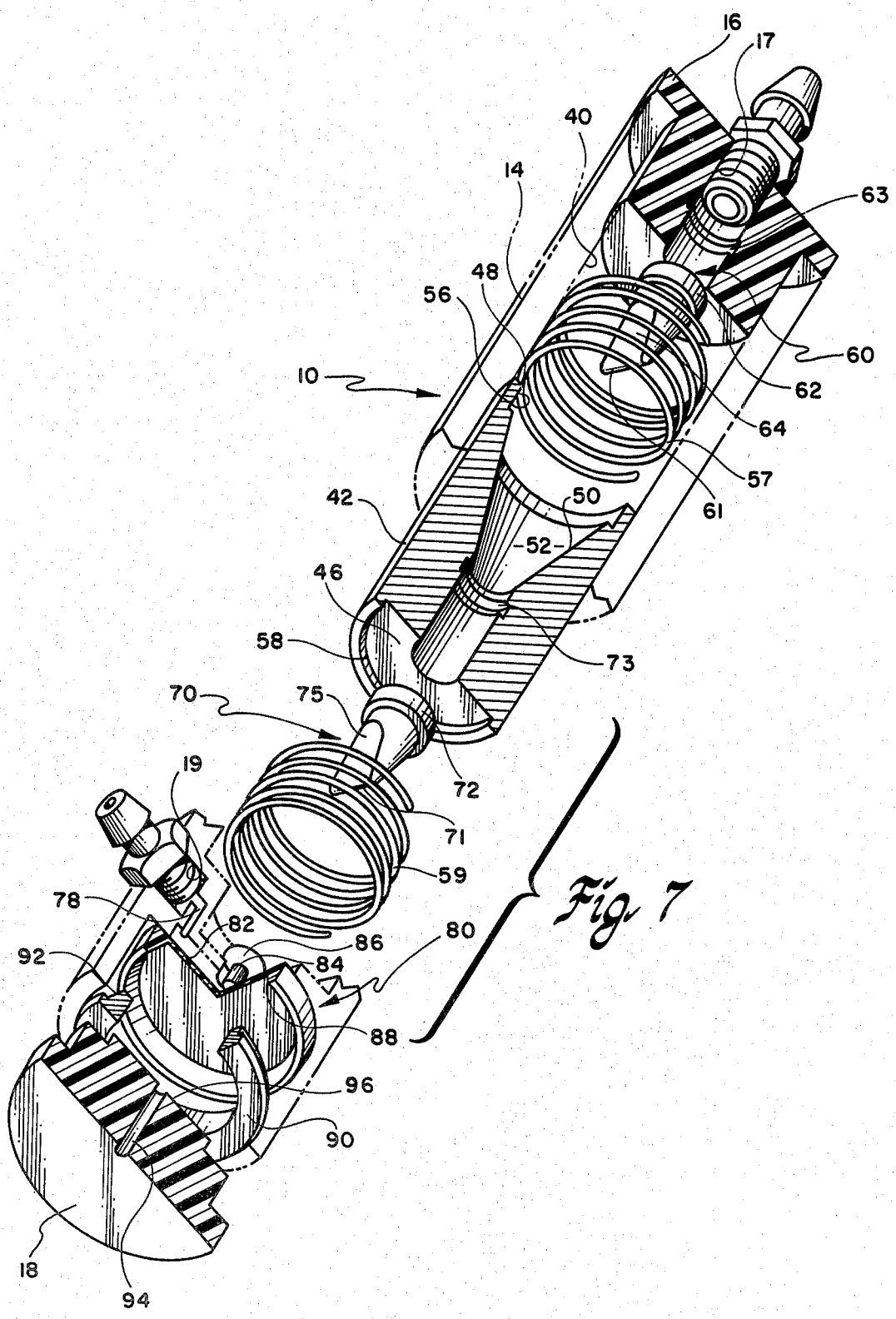
FIG. 7 is an exploded perspective view of the vibration actuated liquid pump.

The exploded perspective view of FIG. 7 clearly shows a pump 10 and the method of assembly of the springs, valves, pistons and regulator.

It would be obvious to fabricate the pump without piston amplifying springs 57 and 59. The pump, in fact, will operate without the amplifying springs 57 and 59. It would additionally be obvious to provide a pressure regulator remote from the pump 10 without departing from the scope of this invention.

It would further be obvious to provide a source of vibration integral with the pump housing 14. For example, an electromagnetic device (not shown) that converts low direct current to pulsating direct current or alternating current could be integral with housing 14 with its own source of power, such as, one or more batteries attached thereto.

A pump as heretofore described with integral vibrating device attached thereto and with the regulating means integral with the pump as heretofore shown would be useful in providing, for example, a self-contained pump to pump liquid from the bottom of a tank or the bilge of a boat or any number of pumping requirements could be fullfilled utilizing the teachings of this invention.

The pump will operate where the direction of oscillation caused by the vibration source is random. For example, with a specific orientation of the pump housing being fixed, a random direction of oscillations from the vibrating source will cause the pump to function more efficiently where the direction of the oscillation is substantially aligned axially with the pump and, as the vibration modes turn to a direction more perpendicular to the pump housing, the pump will become less efficient, gradually becoming more efficient as the mode of oscillation becomes more and more aligned with the axis of the pump. Hence, the pump will operate in almost any mode of oscillatory direction caused by a source of vibration.

Again, the pump will operate from any source of vibration, whether it be electric motors, reciprocating motors, or oscillatory vibration. Any vibration will cause the pump to operate independent from but within the mode of operation of the vibratory source. For example, the pump is ideally suited to internal combustion engines. The instant pump could be mounted in the engine compartment of an automobile without the cumbersome through-the-crankcase mechanical rod actuated diaphragm pumps used by most auto manufacturers today. Any internal combustion engine will benefit from this invention.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. A positive displacement pump for pumping liquids comprising:

an elongated body forming a first liquid inlet end and a second liquid exit end, said body further defining a cylindrical bore therethrough, a free stroking piston having a first pumping end and a second suction end slidably contained within said cylindrical bore, said piston forming a passageway therethrough, said piston, when positioned approximately halfway within said cylindrical bore, defines a first liquid inlet chamber formed between said second suction end of said piston, an inner wall of said cylindrical bore formed by said body and said first inlet end, a second liquid reservoir chamber is formed between said first pumping end of said piston, said inner wall of said cylindrical bore and said second liquid exit end, said first liquid inlet chamber and said second liquid reservoir chamber varying in volume as said piston moves axially within said cylindrical bore, a first spring means adjacent said first pumping end of said piston, a second spring means adjacent said second suction end of said piston to amplify the oscillation of said piston axially to and fro within said cylindrical bore, a source of liquid directed to said first liquid inlet end, a first one-way valve secured to said body in liquid communication with said first liquid inlet end, a second one-way valve secured to said piston in liquid communication with said passageway formed by said piston, said second valve is closed when said piston moves within said cylindrical bore toward said second liquid exit end thereby forcing any liquid within said second liquid reservoir chamber out of said exit end, said first one-way valve communicating with said first liquid inlet end opens substantially simultaneously as said piston moves toward said liquid exit end drawing liquid through said first liquid inlet end from said source of liquid substantially filling said first liquid inlet chamber, as said piston reverses direction at the end of its stroke, said one-way valve in communication with said first liquid inlet end being closed and the valve in communication with said piston is opened thus transferring liquid into said reservoir chamber, thereby completing one cycle of said pump, a liquid regulating means integral with said second liquid exit end of said elongated body, said liquid regulating means includes a resilient diaphragm actuated valve to control liquid flow through a valve seat formed in said second liquid exit end of said body, said resilient diaphragm is rigidized by circumferential enlargement of the diameter of the diaphragm by a diaphragm enlargement means, said diaphragm enlargement means is a non-resilient ring, said ring forming an angled male conically shaped surface slidably engaged with a complementary female conically shaped surface formed by said diaphragm whereby, movement of said non-resilient male conically shaped surface of said ring toward said female conically shaped surface of said diaphragm thereby stretches the diaphragm to effectuate precise control of said valve relative to its valve seat formed in said second liquid exit end of said body, and vibration means having a primary function other than providing a source of vibration for said pump, said vibration means is positioned substantially adjacent said elongated body, vibratory motion, upon operation of said vibration means, being oriented substantially parallel with an axis of said body to move said free stroking piston axially to and fro within said body to pump liquid therethrough from said liquid source.

2. The invention as set forth in claim 1 wherein said pump is self-contained comprising an integral self-driven vibration means to oscillate the piston within the pump.

3. The invention as set forth in claim 3 wherein said vibration means is an operating miniature two-cycle engine with a primary function of driving a propeller, the vibratory motions of said operating engine serves as the source of vibration to drive the positive displacement pump.

* * * * *